US008535755B2

(12) United States Patent
Ajdelsztajn

(10) Patent No.: US 8,535,755 B2
(45) Date of Patent: Sep. 17, 2013

(54) CORROSION RESISTANT RISER TENSIONERS, AND METHODS FOR MAKING

(75) Inventor: Leonardo Ajdelsztajn, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 326 days.

(21) Appl. No.: 12/872,907

(22) Filed: Aug. 31, 2010

(65) Prior Publication Data

US 2012/0051844 A1 Mar. 1, 2012

(51) Int. Cl.
*B05D 1/12* (2006.01)

(52) U.S. Cl.
USPC ..... 427/191; 427/201; 427/367; 427/427

(58) Field of Classification Search
USPC ..... 427/191, 201, 367, 427
See application file for complete search history.

(56) References Cited

U.S. PATENT DOCUMENTS

| | | | | |
|---|---|---|---|---|
| 5,302,414 | A | 4/1994 | Alkhimov et al. | |
| 6,780,458 | B2 | 8/2004 | Seth et al. | |
| 2003/0219542 | A1* | 11/2003 | Ewasyshyn et al. | 427/421 |
| 2004/0037954 | A1 | 2/2004 | Heinrich et al. | |
| 2010/0173172 | A1* | 7/2010 | Killian et al. | 428/684 |

FOREIGN PATENT DOCUMENTS

| | | | |
|---|---|---|---|
| WO | 2008052347 | A1 | 5/2008 |
| WO | 2008057710 | A2 | 5/2008 |

OTHER PUBLICATIONS

H. Tsaprailis, M. Ianuzzi, B. Tossey and L F. Garfias-Mesias; "Testing of High Corrosion Resistant Metallic Coatings for Tensioner Risers and Piston Rods Exposed to Marine Environments"; 13 Pages.
Ramin Ghelichi and Mario Guagliano; "Coating by the Cold Spray Process: a state of the art"; R. Ghelichi et alii, Frattura ed Integrity Strutturale, 8 (2009) 30-44; DOI: 10.3221/IGF-ESIS.08.03.
Search Report and Written Opinion from corresponding NL Application No. 2007320 dated Jun. 17, 2013.

* cited by examiner

*Primary Examiner* — Frederick Parker
(74) *Attorney, Agent, or Firm* — Andrew J. Caruso

(57) ABSTRACT

A method for making a riser tensioner component is provided. The method comprises the steps of (a) applying a cold spray composition to a metal substrate to achieve a first coating on the metal substrate, wherein the cold spray composition comprises a metal alloy, and wherein the first coating has a thickness in a range from about 5 to about 50 mils; and (b) rough finishing the first coating to achieve a second coating having an average roughness, $R_a$ of less than about 32 micro-inches. A riser tensioner component is also provided, wherein the riser tensioner component comprises a cold spray applied coating on a metal substrate, wherein the coating comprises a metal alloy, and wherein the coating has a thickness in a range from about 5 to about 50 mils; and an average roughness, $R_a$ of less than about 32 micro-inches.

10 Claims, 3 Drawing Sheets

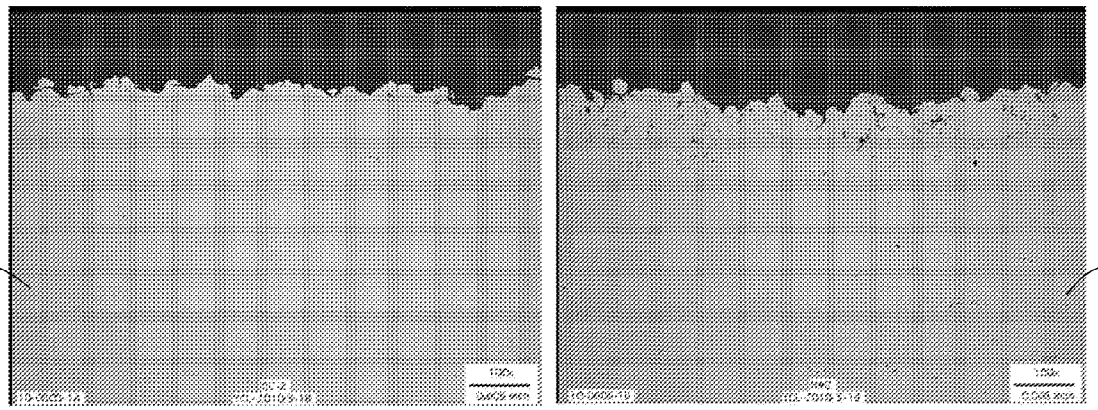
FIG. 3A
FIG. 3B
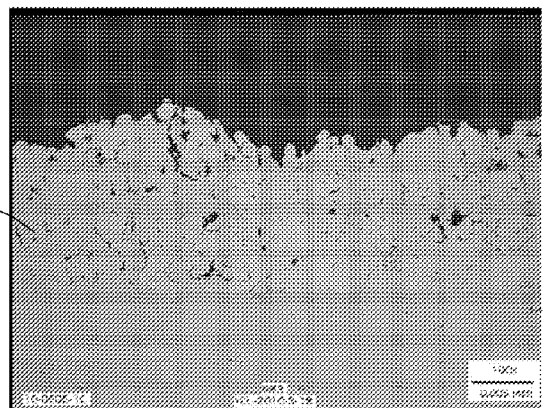
FIG. 3C
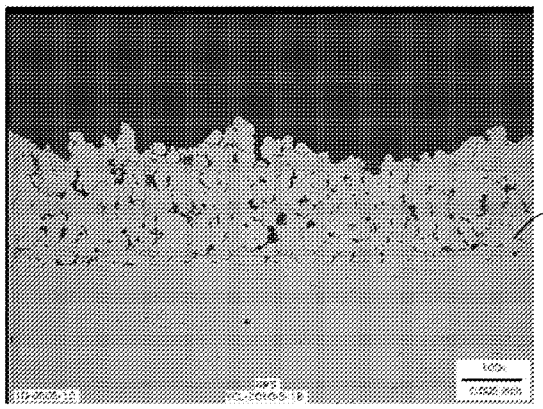
FIG. 3D

CORROSION RESISTANT RISER TENSIONERS, AND METHODS FOR MAKING

BACKGROUND

The aim of applying coatings is to improve surface properties of an object. Coatings can affect physical properties of various materials depending upon the composition of the coating materials, and the method of forming the coatings. Such properties include, but are not limited to, corrosion, adhesion, hardness, elasticity, temperature sensitivity and pressure sensitivity. Advances in coating technology have increased the quality, specificity (such as hydrophobicity) and compatibility of coatings with various objects and their use in various applications.

In response to increasing demand for damage tolerant, harsh-environment resistant coatings, a variety of relatively high-temperature alloy-coating processes have been developed and include for example plasma spray coating processes, thermal spray coating processes, and laser cladding processes. The disadvantages of these processes include the deleterious effects of high-temperature oxidation, evaporation, melting, crystallization, generation of residual stresses, gas release, high cost, and/or waste of raw materials, among others. These disadvantages may be minimized or eliminated in a recently developed coating process known as cold spray coating. Cold spray coating, sometimes referred to as cold gas-dynamic spraying, involves directing a stream of small solid metal particles projected from a spray device and traveling at high velocity onto a substrate. The cold spray process may be used to generate a high quality alloy coating, which has a low metal oxide content, a nearly theoretical bulk density, unusually high thermal and electrical conductivity, and low residual stresses. The cold spray process is economical, fast and useful in diverse applications.

In applications such as offshore oil drilling, floating drilling rigs, also referred to as platforms, often include direct-acting riser tensioners to compensate for wave-induced motion of the platform. Such direct-acting tensioners typically comprise a massive hydraulic cylinder that continuously dampens wave-induced platform motion, thereby stabilizing operations on the drilling rig. Typically, the hydraulic cylinders of the riser tensioners are mounted below the deck of the drilling rig in close proximity to the water, i.e., in a splash zone, and are therefore often exposed to an extremely corrosive and wear-inducing environment from airborne salt spray, seawater, ice, moving cables, and/or other debris. Additionally, the hydraulic cylinders may undergo thousands of wear-inducing displacements against multiple hydraulic cylinder seals. Therefore, there is a need for riser tensioner components comprising coatings having excellent wear and corrosion resistance and methods for making such components.

TECHNICAL FIELD

The present invention generally relates to a corrosion-resistant coating and more particularly to methods of forming a corrosion-resistant coating on a metal substrate component of a riser tensioner.

BRIEF DESCRIPTION

In accordance with one aspect of the present invention, a method for making a riser tensioner component is provided that includes the steps of (a) applying a cold spray composition to a metal substrate to achieve a first coating on the metal substrate, wherein the cold spray composition comprises a metal alloy, and wherein the first coating has a thickness in a range from about 5 to about 50 mils; and (b) rough finishing the first coating to achieve a second coating having an average roughness, $R_a$ of less than about 32 micro-inches.

In accordance with another aspect, the present invention provides a riser tensioner component comprising a cold spray applied coating on a metal substrate, wherein the coating comprises a metal alloy, and wherein the coating has a thickness in a range from about 5 to about 50 mils; and an average roughness, $R_a$ of less than about 32 micro-inches.

In accordance with another aspect, the present invention provides a riser tensioner component comprising a cold spray applied wear-resistant coating on a steel substrate, wherein the coating comprises a cobalt (Co) based alloy, wherein the coating has a thickness in a range from about 5 to about 50 mils and an average roughness, $R_a$ of less than about 32 micro-inches, and wherein the wear-resistant coating is substantially resistant to corrosion from seawater at an ambient temperature of from about −40° C. to about 50° C.

Other embodiments, aspects, features, and advantages of the invention will become apparent to those of ordinary skill in the art from the following detailed description, the accompanying drawings, and the appended claims.

BRIEF DESCRIPTION OF THE DRAWING FIGURES

These and other features, aspects, and advantages of the present invention will become better understood when the following detailed description is read with reference to the accompanying drawings in which like characters represent like parts throughout the drawings, wherein.

Figure 1:
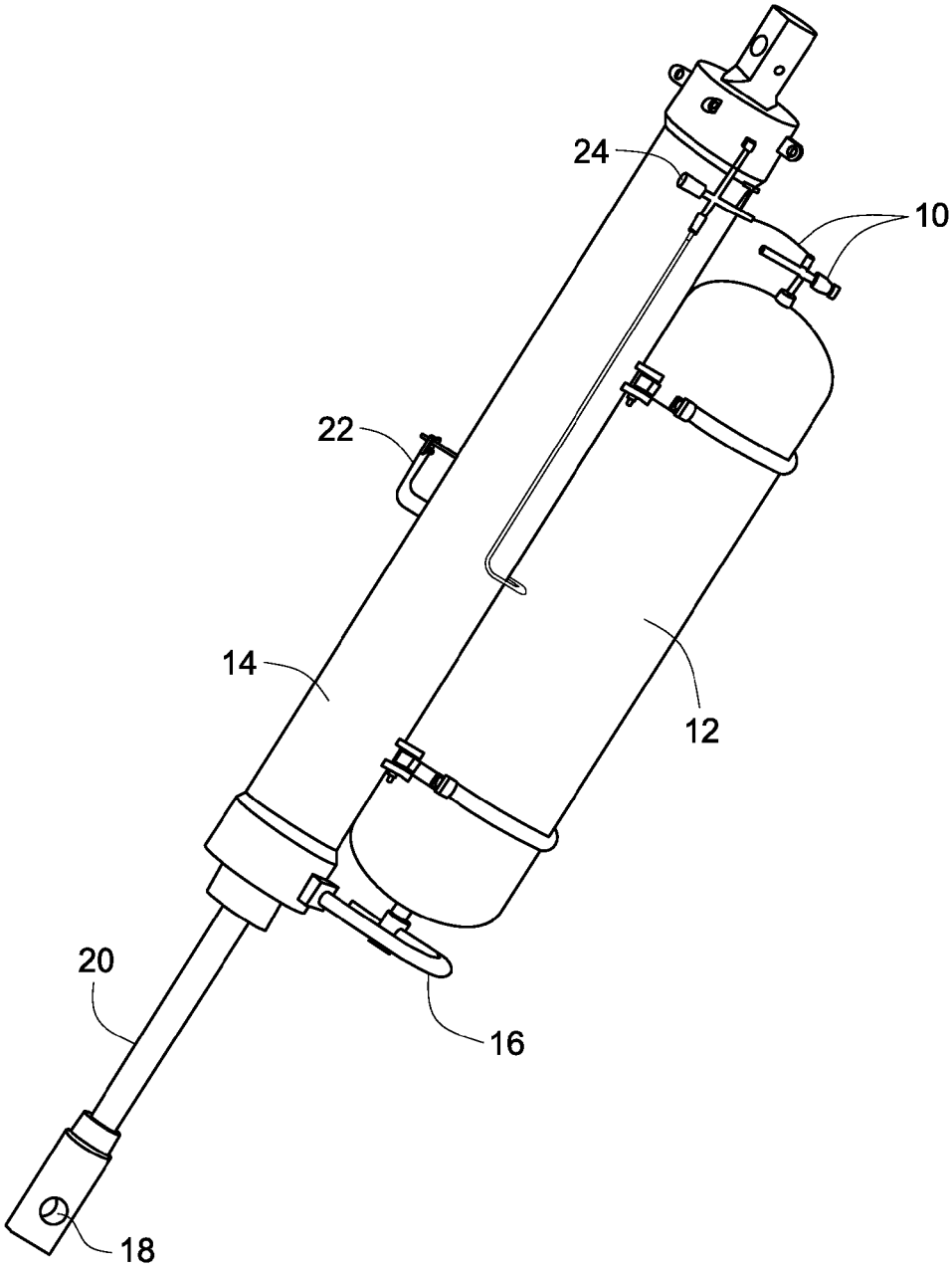
FIG. 1 depicts a riser tensioner comprising a cold spray coated riser tensioner component of the invention.

FIGS. 3A, 3B, 3C, and 3D are images of cold spray composition coatings on substrates generated by a cold spray process using a carrier gas comprising 98% He, 80% He, 60% He, and 40% He respectively.

DETAILED DESCRIPTION

As discussed in detail below, embodiments of the present invention include a method for making a riser tensioner component by applying a cold spray composition to achieve a first coating. The method further includes a rough finishing of the first coating to achieve a second coating with an average roughness, $R_a$ of less than about 32 micro-inches.

The singular forms "a", "an" and "the" include plural referents unless the context clearly dictates otherwise.

To more clearly and concisely describe and point out the subject matter of the claimed invention, the following definitions are provided for specific terms, which are used in the following description and the appended claims. Throughout the specification, use of specific terms should be considered as non-limiting examples.

As used herein, the term "rough finishing" refers to a method of imparting a roughness to a surface, and the surface roughness can be measured by a parameter, average roughness, $R_a$. In the context of the present invention, it is convenient to equate the term "rough finishing" with the term "smoothing".

As used herein, the term "average roughness", $R_a$ refers to a measure of the texture of a surface of a substrate. More specifically, the $R_a$ refers to an arithmetic average of the roughness profile of a coating surface. The $R_a$ measures an average distance between the highest peak and the lowest valley of the surface. More specifically, a microscopic valley on the surface corresponds to a point on the surface that lies below an average line. Similarly, a microscopic peak on the surface corresponds to a point on the surface that lies above the average line. Thus, measurements of distances between such peaks and valleys determine the average roughness, $R_a$.

In one embodiment, the present invention provides a method for making a riser tensioner component, wherein the method comprises the steps of applying a cold spray composition to a metal substrate to achieve a first coating having a thickness in a range from about 5 to about 50 mils on the metal substrate, and rough finishing of the first coating to achieve a second coating having an average roughness, $R_a$ of less than about 32 micro-inches.

In one embodiment, the cold spray composition comprises metal particles in powdered form, for example an alloy monolith, which is milled or gas atomized into a powder. In an alternate embodiment, the cold spray composition comprises metal particles formed by an alternate process, for example reductive precipitation of zero valent metal particles from solution. A cold spray gun employing a pressurized carrier gas is used to spray the cold spray composition onto a substrate with a speed that is sufficient to carry the particles and to create intimate contact between the sprayed particles and the substrate surface. In one embodiment, the particles of the cold spray composition are applied to the surface of the substrate at speeds of up to 1200 meters per second (m/s). The cold spray technique may be used to deposit a variety of metallic coating compositions and metal composite compositions onto a substrate, at or near room temperature in an ambient air environment without substantially heating either the cold spray coating composition or the substrate. As noted, the cold spray composition used according to one or more embodiments of the present invention comprises a metal alloy. Suitable metal alloys may include an element selected from the group consisting of nickel (Ni), cobalt (Co), manganese (Mn), and combinations thereof. In a specific embodiment, the metal alloy comprises Co.

In one embodiment, Ni, Co, or Mn may be present in the metal alloy present in the cold spray coating composition in an amount corresponding to from about 1 part to about 90 parts by weight based on 100 parts by weight of the metal alloy. In various embodiments, a coating of the metal alloy comprising Ni, Co and/or Mn provides an excellent corrosion-resistance property to the coated substrate. In one embodiment, the composition of the metal alloy comprises about 25 parts by weight chromium (Cr), about 9 parts by weight Ni, about 5 parts by weight molybdenum (Mo), about 2 parts by weight of tungsten (W), about 0.05 parts by weight of carbon (C) and about 58.95 parts by weight of iron (Fe) based on 100 parts by weight of the metal alloy (for example, the alloy may be commercially available under the trade name of Micro-Melt® alloy from Carpenter Technology Corporation of Reading, Pa.). A suitable Ni-containing metal alloy, for example, may include about 65 parts by weight Ni, about 20 parts by weight Cr, about 8 parts by weight Mo, about 3.5 parts by weight of a combination of niobium (Nb) and tantalum (Ta), and about 3.5 parts by weight of Fe based on 100 parts by weight of the metal alloy (for example, the alloy may be commercially available under the trade name Inconel® 625). Additional examples of suitable Ni alloys, which may be used as the cold spray composition, include Inconel® 706, Inconel® 718, and Inconel® 725 in powdered form. A suitable cobalt-containing metal alloy may include about 54 parts by weight Co, about 26 parts by weight Cr, about 9 parts by weight Ni, about 5 parts by weight Mo, about 3 parts by weight Fe, about 2 parts by weight W, and about 1 part by weight of a combination of Mn, silicon (Si), nitrogen (N) and carbon (C) (for example, the alloy may be commercially available under the trade name Ultimet®). A non-limiting example of another Co-based metal alloy may include Stellite® 21 from Stellite Coatings of Goshen, Ind. For cold spray compositions, various Co based alloys are used unless the carbide content of the alloy is high. For example, the successful use of Stellite® 6 is apparently rendered difficult in a cold spray process, as the carbide content of Stellite® 6 is relatively high. It is believed that particles of Stellite® 6 may not deform sufficiently upon impact with the substrate because of the hardness of the particles. Thus, instead of the cold spray composition, building up a coating on the surface of the substrate, the hard particles of the Stellite® 6 cold spray composition tend to erode the previously deposited layer.

As noted, the cold spray composition typically comprises a metal alloy, which is used in a powdered form. In cold spraying, the powder particles of the cold spray composition are accelerated to a critical velocity at a temperature below the melting point of the powder particles, and impact and adhere to the surface of the substrate thereby forming a coating on the surface of the substrate. The lower temperature used in the cold spray coating process, relative to conventional metal alloy coating techniques such as thermal spray coating, may aid in retaining the chemical identity of cold spray composition components and reduce the tendency of metal species to undergo oxidation at the high temperatures associated with conventional metal alloy coating techniques. The impact of the particles of the cold spray composition upon the substrate surface at high velocity results in intimate contact between the substrate surface and the deposited cold spray composition, providing a strong bond between the cold spray composition coating and the substrate.

During the application of a cold spray composition, the powder particles present in the cold spray composition are projected from a cold spray gun that produce a stream of cold spray composition particles within a supersonic jet of carrier gas. The cold spray composition particles impact the substrate surface with sufficient energy to cause plastic deformation of the particles and their consolidation into a coating on the substrate surface. The cold spray coating process typically uses the energy stored in high-pressure compressed carrier gas to propel fine powder particles at very high velocities.

In one embodiment, the carrier gas comprises helium (He). In an alternate embodiment, the carrier gas comprises nitrogen ($N_2$). In yet another embodiment, the carrier gas comprises a nitrogen-helium mixture. In one embodiment, the carrier gas may comprise air, or a combination of air with He. The particle velocity of the cold spray composition impacting the surface of the substrate may be affected by the identity of the carrier gas employed. In one embodiment, higher particle velocities may be achieved using He as the carrier gas. In some embodiments, $N_2$ gas is used and is well suited for the cold gas spraying process as $N_2$ is generally inert and is low cost relative to He. Conversely, air, in spite of its high $N_2$ content, is feasible only for a few applications due to its oxygen content. In certain embodiments, the consumption of carrier gas during cold gas spraying has significant impact on the cost of the overall process. In one embodiment, the carrier gas is consumed at a rate of from about 40 to about 200 cubic meters per hour ($m^3$/hr). As will be appreciated by those of ordinary skill in the art, carrier gas consumption may depend on both the identity of the carrier gas employed and the nature of the cold spray composition used.

In one embodiment, the carrier gas is supplied via a heating unit to a gun comprising a specially designed nozzle, wherein the compressed gas exits through the nozzle at a very high velocity. The nozzle may be a Laval type convergent-divergent nozzle. Generally, the smallest cross-section of the nozzle may be about 2.7 mm because 1 cubic meter nitrogen per minute is required for supersonic velocity. The acceleration of the particles may be dependent upon the carrier gas density and be further determined by the particle density of particles within the cold spray composition. In one embodiment, the carrier gas is supplied via a high-pressure powder feeder to form a jet comprising the carrier gas and cold spray composition particles.

As noted, directing of a jet comprising the carrier gas and cold spray composition particles at high velocity onto the surface of a substrate provides a coated substrate at times herein referred to as a first coating. In the practice of the present invention, the first coating is subjected to a rough finishing step which converts the first coating into a second coating having an average roughness, $R_a$ of less than about 32 micro-inches. In one embodiment, the second coating has an average roughness, $R_a$ of less than 32 micro-inches. In an alternate embodiment, the second coating has an average roughness, $R_a$ of less than 20 micro-inches. In various embodiments, the rough finishing of the first coating provides a second coating having an average roughness Ra which is different from the average roughness of the first coating and the second coating is characterized by one or more performance enhancements linked to this change in surface roughness. In one embodiment, the change in roughness improves the hydrophobicity of the second coating relative to the first coating. In an alternate embodiment, the change in roughness results in improved abrasion resistance. The first coating may be rough finished by any suitable process, for example, the rough finishing step may comprise one or more of machining, grinding, and/or polishing steps, or a combination of two or more such steps. In one specific embodiment, the rough finishing of the first coating comprises machining to provide a second coating having an average surface roughness of less than 32 micro-inches. In one embodiment, the second coating is characterized by an average roughness, $R_a$, of from about 10 micro-inches to about 20 micro-inches. In one embodiment, the method of the present invention comprises machining the first coating to provide a second coating having an average roughness, $R_a$ in a range from about 2 micro-inches to about 20 micro-inches. In an alternate embodiment, the method of the present invention comprises machining the first coating to provide a second coating having an average roughness, $R_a$ in a range from about 2 micro-inches to about 18 micro-inches. In yet another embodiment, the method of the present invention comprises machining the first coating to provide a second coating having an average roughness, $R_a$ in a range from about 2 micro-inches to about 16 micro-inches. Surface roughness of the coatings provided by the present invention may be measured in accordance with ASME (American Society of Mechanical Engineers) B46.1 "surface texture (surface roughness, waviness, and lay)" test method. The second coating is corrosion-resistant and wear-resistant. As will be appreciated by those of ordinary skill in the art, coatings having rougher surfaces tend to wear more quickly than comparable coatings having smoother surfaces, since irregularities such as peaks and valleys in coating surfaces may form initiation sites for cracks, stress zones, and/or corrosion. Therefore, since the wear-resistant coatings employed according to the method of the present invention have an average roughness of less than about 32 micro-inches, and in certain embodiments have an average roughness in a range from about 2 micro-inches to about 20 micro-inches, the wear-resistant coatings exhibit excellent smoothness and resulting wear- and corrosion-resistance. In one embodiment, the second coating has a density of about 8.47 grams per cubic centimeter (gm/cc).

As noted, the cold spray composition coating forms by adhesion of the metal alloy particles of the cold spray composition to the surface of the substrate. The adhesion of the particles depends on many factors, such as: the area of the contact surface, the velocity of the cold spray composition particles incident upon the surface of the substrate, the angle of impact of the particles with the surface of the substrate, and the pressure and temperature of the coating material. The adhesion of the coating material is primarily a mechanical interlocking of the cold spray coating with the surface of the substrate. In some embodiments, the adhesion may be due at least in part to metallurgical bonding between the cold spray composition and the surface of the substrate, a condition believed to be influenced by the conditions under which the cold spray composition impacts the substrate, with increased thermal and kinetic energy of the cold spray composition impacting the substrate surface being seen as favoring the formation of a metallurgical bond between the coating and the substrate. The efficiency of particle-substrate adherence significantly depends on the cold spray composition particle velocity prior to impact with the substrate. As noted, cold spray composition particle velocity may be strongly dependent on the conditions of the spray process, including carrier gas type, carrier gas pressure, carrier gas temperature, and cold spray composition material properties, such as particle diameter, density and morphology.

In one embodiment, the cold spray process is carried out at a pressure between 1 and 60 bar (1 to 6 MPa), or specifically 20 to 40 bar (2 to 4 MPa). The pressure range is easily achieved with commercially available equipment. With respect to the temperature at which the cold spray coating process is carried out, generally temperatures lower than the melting point of the cold spray composition. The associated carrier gas may have a temperature, which is below the melting point of the cold spray composition, so that particles present in the cold spray composition during application do not melt in the gas jet, and that oxidation and/or phase transformations of the coating materials may be largely avoided. As an example, Ni has a melting point of 1550° C., so the desired temperatures may be less than 1550° C. because the Ni particles present in a cold spray composition being applied in a cold spray process remain do not melt in the gas stream (jet) comprising the carrier gas and the cold spray composition. Temperatures may also vary depending on the gas used. For example, He allows operating at higher velocities and temperature as compared to $N_2$ because the adherence of cold spray composition particles to the nozzle surface is typically less for He than for alternate carrier gases. In one embodiment, the temperature of the carrier gas is adjusted to be below the melting point of a particular cold spray composition. Thus, in various embodiments, the temperature of the carrier gas for the deposition of a cold spray composition comprising copper particles, aluminum particles, Ta particles, or Cr particles are 580° C., 680° C., 600° C., and 800° C. respectively. With $N_2$ as the carrier gas, particles may be accelerated to about 1200 m/s, however, in some instances it may be difficult to propel particles at velocities sufficient to reach a suitable minimum temperature for adherence to the substrate upon impact.

In one or more embodiments, the substrate may be a metal substrate. In one embodiment, the metal substrate is an iron based metal alloy. For example, the metal substrate may comprise carbon steel, alloy steel, stainless steel, tool steel, cast iron, or a combination of two or more of the foregoing materials. In one embodiment, the metal substrate comprises at least 98% Fe, and at most 0.31% C. In another embodiment, the metal substrate comprises at least 98% Fe, at most 0.31% C, and at most 1.9% Mn.

As noted, the metal substrate may be a riser tensioner component, for example a hydraulic cylinder rod. The riser tensioner may be a pull-up tensioner, a push-up tensioner, or an air can. The pull-up tensioner with a shorter stroke capacity may have a suitable length of about 5 to about 10 feet (ft). A push-up tensioner with a long stroke capacity may have a suitable length of about 30 ft. The cold spray coating may be deposited on various parts of the riser tensioner, such as, tension ring, drilling riser, cylinder accumulator, cassette frame, PRT centralizer, control panel, or pushup RAM tensioners. In some embodiments, the hydraulic cylinder rod may have any suitable size according to a desired application. For drilling rig applications, the hydraulic cylinder rod may be configured to translate into and out of a sealed cylinder housing and may have a length of from about 480 inches to about 720 inches, and a diameter of from about 5 inches to about 20 inches. Further, the metal substrate may have a single surface, e.g., when configured as a solid cylinder rod, or may have more than one surface, e.g., when configured as a hollow cylinder rod. In one embodiment, the present invention provides a riser tensioner comprising about 60 lb (pound) of the cold spray composition configured as a second coating on a component of the riser tensioner.

In one embodiment, a riser tensioner component comprises a cold spray applied coating on a metal substrate, wherein the coating comprises a metal alloy, and wherein the coating has a thickness in a range from about 5 to about 50 mils; and an average roughness, $R_a$ of less than about 32 micro-inches. In another embodiment, the coating has a thickness in a range from about 5 to about 25 mils. In one embodiment, the cold spray coating on the substrate has a density in a range from about 7.5 gm/cc to about 9.5 gm/cc. In one specific embodiment, the cold spray coating on the substrate has a density of about 8.47 gm/cc. In a specific embodiment, the riser tensioner component comprises a cold spray applied, wear-resistant coating on a steel substrate. In one embodiment, the coating comprises a Co based alloy and the wear-resistant coating is substantially resistant to corrosion from sea-water at an ambient temperature of from about −40° C. to about 50° C.

In one embodiment, the present invention provides a method for making a riser tensioner component wherein the cold spray composition is applied to the substrate at a rate of about 15 lb/hr. In various embodiments, it may be possible to enhance the rate at which the cold spray composition is deposited upon the substrate by modifying the nozzle design of the cold spray apparatus employed. The thickness of the coating generated by the cold spray process and necessary for effective protection of the riser tensioner components provided by the method of present invention is generally in a range between about 5 to about 50 mils, however, the thickness may be increased depending on design requirements and the particular cold spray composition employed. In one embodiment, to meet design requirements for corrosion resistance, wear resistance and impact performance, of the riser tensioner component, the cold spray composition is deposited on the substrate to form a first coating having a thickness in a range from about 4 to about 280 mils. As will be appreciated by those of ordinary skill in the art, the absence of a heating zone at the interface of the coating layer and the substrate surface during application of the cold spray composition reduces the diffusion of Fe from a metal substrate comprising iron into the coating layer. In one embodiment, the coating may be formed on at least one surface of the metal substrate. In an alternate embodiment, the coating is formed on multiple surfaces of a metal substrate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

EXPERIMENTAL PART

Practice of the invention will be more fully understood from the following examples, which are presented herein for illustration only and should not be construed as limiting the invention in any way.

The following series of examples present exemplary methods for cold spray coating in accordance with some embodiments of the present invention. A description of a manufacturing process for a riser tensioner component using the cold spray coating is provided. In addition, methods for the characterization of the cold spray composition disposed as a coating on a substrate such as a riser tensioner component are also presented.

Materials: The commercially available metal alloy cold spray composition Micro-Melt®, may be purchased from Carpenter Technology Corporation of Reading, Pa. Ultimet® cold spray composition may be purchased from Deloro Stellite Coatings of Goshen, Ind. Carrier gases helium (He), and nitrogen ($N_2$) are available through local gas vendors.

Example 1

Method of Making a Riser Tensioner Component

Depending on the design of the hydraulic actuator, the substrate is a pipe or a rod, which is coated by the cold spray coating process. The substrate or the component (rod or pipe) is first coated with the metal alloy of cold spray composition and then the component is assembled into the riser tensioner system (FIG. 1) for further use. The riser tensioner of FIG. 1 comprises thermal and pressure relief devices 10, a composite accumulator 12, a cylinder 14, a stainless steel flow loop 16, a rod extension sleeve 18, a steel rod 20 coated with the cold spray composition ULTIMET wherein the coating has a thickness in a range from about 2 to about 50 mils and an average roughness $R_a$ of 32 micro-inches or less, a hurricane isolation valve 22, and a low pressure relief device 24. Some of the methods known in the art, cause retention of debris at the interface of the coating layer and the substrate that may promote crack propagation and may induce spallation of fragments from the coatings. In the embodiment described here, the steel rod substrate is first degreased and cleaned such that the rod is free of surface oils, dirt and any other organic materials in amounts likely to affect the cold spray composition coating. One or more of rotatable cold spray guns are used to deposit the cold spray composition onto the surface of the substrate rod, such that spinning movement of the guns maintains a tangential surface velocity of the jet comprising the carrier gas and the cold spray composition between 150 to 1200 m/s. The cold spray gun is placed at about 25 mm distance from the surface of the substrate. The high pressure compressed carrier gas, such as helium (He) is employed to accelerate the ULTIMET cold spray composition particles to a velocity of about 500 msec during the deposition of cold spray coating on the surface of the substrate. The coating process is performed at ambient temperature. The cold spray guns translated along the axis of the rod to form a uniform, dense, high quality, corrosion resistant and wear resistant coating on the entire surface of the rod.

The surface of the rod is then rough finished by machining to generate a surface with an average roughness of about 32 micro-inches. The substrate or the component (rod or pipe) may then be assembled into the riser tensioner system using techniques known to those of ordinary skill in the art.

Figure 2A:
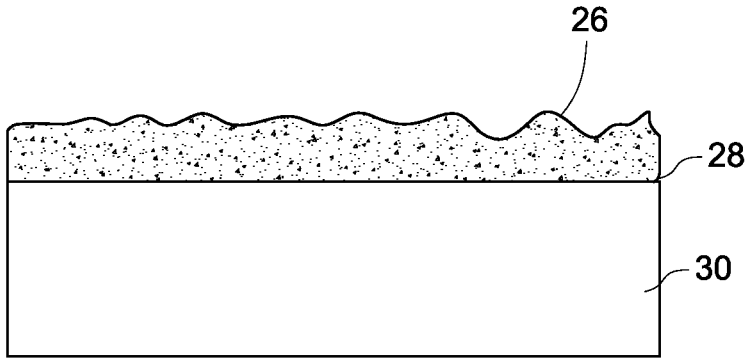
FIGS. 2A and 2B depict the coatings on the substrates generated by laser cladding and cold spray process respectively.
Figure 2B:
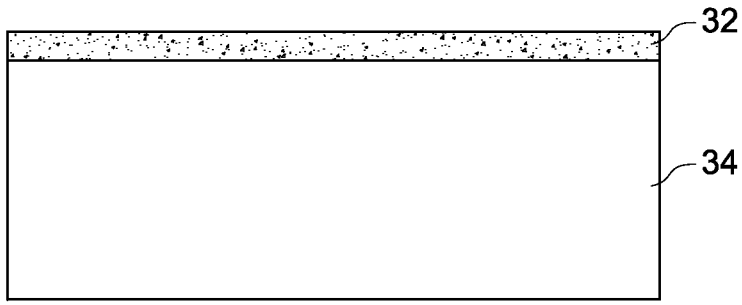

Characterization Method 1: Comparison of Cold Spray Coating with Laser Cladded Coating Substrates having material characteristics similar to those used in riser tensioner components are coated (FIG. 2B) using a cold spray process analogous to that described in Example 1. A comparative sample (control) is made using a conventional laser cladding process (FIG. 2A). Both samples are then characterized and contrasted. FIG. 2A shows a diffusion layer coating 26 deposited on a steel substrate 30 by laser cladding, wherein the coating is thick and the surface of the coating has a roughness. The interface of the coating and the substrate has a heat-affected zone 28. FIG. 2B shows a coating 32 deposited on a steel substrate 34 using a cold spray technique analogous to that used in Example 1, wherein the coating 32 is thinner, and smoother than the coating 26 deposited by laser cladding (FIG. 2A).

Characterization Method 2: Comparison of Surface Structures of Cold Spray Coating Coatings were prepared by cold spraying of the cold spray composition Ultimet® using different amount of He or $N_2$ carrier gas and the surfaces of the cold spray coatings were characterized. FIGS. 3A, 3B, 3C, and 3D are the images of four different coatings deposited on the substrate by the cold spray process, wherein the amount of He in the carrier gas was varied from 98% to 40%. The amount of He is 98% (36) in FIG. 3A, 80% (38) in FIG. 3B, 60% (40) in FIG. 3C, and 40% (42) in FIG. 3D. As will be recognized by those of ordinary skill in the art, the use of a carrier gas comprising less He results in a cold spray coating having poorer surface morphology. This is believed to be due to reduced particle velocity in the jet comprising the cold spray composition and the carrier gas, which in turn results in reduced particle impact velocity at the substrate surface. As can be seen in FIGS. 3A-3D, the porosity of the coating increases, as the volume fraction of nitrogen in the carrier gas increases.

What is claimed is:

1. A method for making a riser tensioner component, the method comprising:

(a) applying a cold spray composition to a metal substrate to achieve a first coating on the metal substrate, wherein the metal substrate is a riser tensioner component, wherein the cold spray composition comprises a metal alloy comprising an element selected from the group consisting of cobalt, manganese and combinations thereof, and wherein the first coating has a thickness in a range from about 5 to about 50 mils; and (b) rough finishing the first coating to achieve a second coating having an average roughness, $R_a$ of less than about 32 micro-inches.

2. The method of claim 1, wherein the rough finishing comprises one or more of machining, grinding, or polishing.

3. The method of claim 1, wherein the rough finishing of the first coating comprises machining.

4. The method of claim 1, wherein said second coating has an average roughness, $R_a$ in a range from about 10 micro-inches to about 20 micro-inches.

5. The method of claim 1, wherein the second coating has a density in a range from about 7.5 to about 9.5 gm/cc.

6. The method of claim 1, wherein the metal alloy comprises cobalt.

7. The method of claim 1, wherein the metal substrate comprises at least 98% by weight iron, and at most 0.31% by weight carbon.

8. The method of claim 1, wherein the metal substrate comprises at least 98% by weight iron, at most 0.31% by weight carbon, and at most 1.9% by weight manganese.

9. The method of claim 1, wherein the second coating is corrosion-resistant.

10. The method of claim 1, wherein the second coating is wear-resistant.

* * * * *